United States Patent [19]

Davis et al.

[11] 4,010,499

[45] Mar. 8, 1977

[54] INVALID TRANSPORT

[76] Inventors: Alden B. Davis, 8022 E. Whitton Ave., Scottsdale, Ariz. 85252; Earl S. Dutmers, 107 W. Broadway, Moulton, Iowa 52540; Mariane L. Englund, 1627 W. Pierson, Apt. 3, Phoenix, Ariz. 85015

[22] Filed: July 17, 1975

[21] Appl. No.: 596,580

[52] U.S. Cl. ..... 5/81 R; 5/86; 280/47.38; 297/DIG. 4; 297/417

[51] Int. Cl.[2] ..... A47C 7/50; A47B 83/04; A61G 5/00

[58] Field of Search ..... 5/81 R, 86, 89; 297/DIG. 4, 45, 384, 345, 417; 296/20; 280/47.34, 47.38, 281; 180/6.5

[56] References Cited

UNITED STATES PATENTS

| | | | |
|---|---|---|---|
| 3,139,306 | 6/1964 | Jennings | 297/DIG. 4 |
| 3,191,990 | 6/1965 | Rugg et al. | 297/DIG. 4 |
| 3,829,916 | 8/1974 | James | 5/81 R |
| 3,882,949 | 5/1975 | Anderson | 297/DIG. 4 |

*Primary Examiner*—Casmir A. Nunberg
*Attorney, Agent, or Firm*—Cahill, Sutton & Thomas

[57] ABSTRACT

An invalid transport is disclosed for supporting an invalid person to allow their ready transportation to, and facilitated entry into, an automobile. The supporting seat of the transport raises and tilts to position the invalid directly inside the automobile. Transfer of the invalid from the transport seat to the automobile seat is then safely and easily accomplished.

3 Claims, 9 Drawing Figures fig. 6a
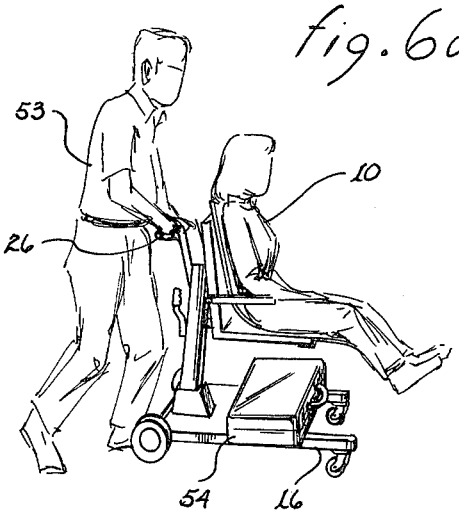
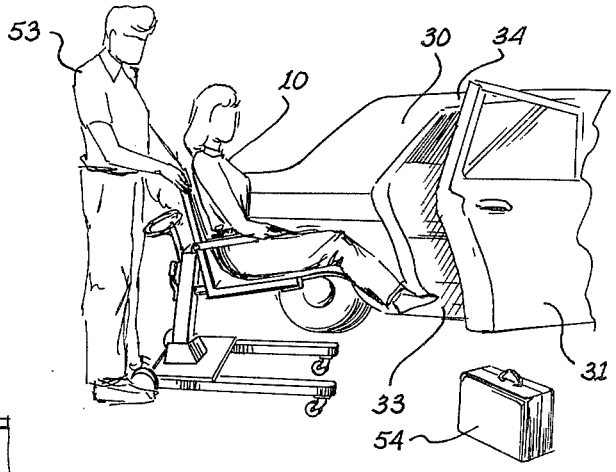
fig. 6b
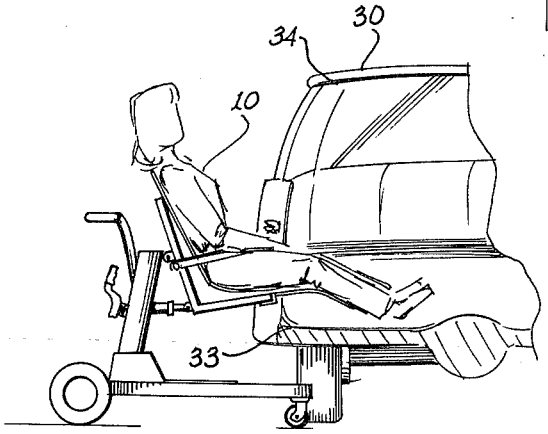
fig. 6c
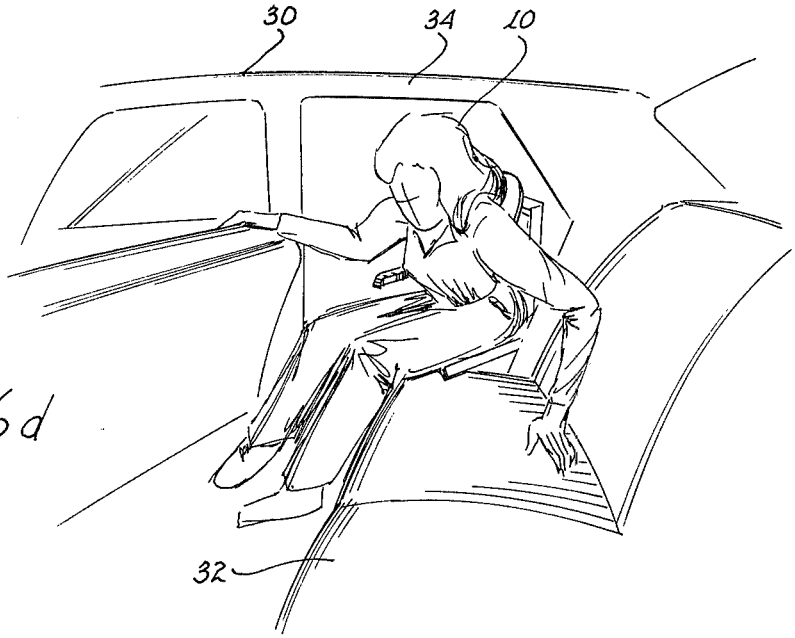
fig. 6d

INVALID TRANSPORT

Field of the Invention

This invention relates to invalid transports, and more particularly, to invalid transports adapted to facilitate the entry of an invalid into a vehicle.

DESCRIPTION OF THE PRIOR ART

It is well known to transport invalids in wheel chairs or wheeled carriers. Although the usual wheel chair or carrier is effective to move an invalid from one place to another, they have been ineffective for use to transport an invalid to an automobile and then assist in the transfer of the invalid from the carrier or wheel chair to the auto. Because of the design of these prior carriers and wheel chairs, it has been impossible to support the invalid in a position extending significantly beyond the door opening of the automobile. This results from the low frame of the automobile and the relatively high wheels and frames of the prior art wheel chairs and wheel carriers. Examples of this prior art may be found in the following U.S. Pat. Nos.: 2,339,361; 2,592,025; 2,849,051; 3,139,306; 3,198,575; and 3,261,031.

It is therefore an object of this invention to provide an invalid transport suitable for both transporting an invalid to an automobile, and for extending into the automobile to facilitate the transfer of the invalid to the automobile seat.

An improvement over the above prior art devices was a hospital chair disclosed in U.S. Pat. No. 2,609,862. The supporting undercarriage of this chair was low enough to fit under the side rails of a hospital bed, permitting its support area to be positioned approximately at the mattress level of a bed. An invalid could then be readily transferred from the bed to the chair and vice versa. Because the support area of this chair connects to its undercarriage via a central column, the chair cannot extend completely over the hospital bed but may only extend to a point where the support or seating area of the chair extends a nominal distance past the edge of the mattress of the bed.

It is also an object of this invention to provide an invalid carrier having a cantilevered structure supporting the seating area to permit the seating area to be placed substantially beyond the edge of another object.

An invalid carrier with a rotatable chair was disclosed in U.S. Pat. No. 2,673,987 which utilized a cantilevered seating area. However, this invalid carrier was supported by three wheels which produces a carrier lacking the stability to permit significant movement of the supported invalid without exceeding the stable limits of the carrier.

It is another object of this invention to provide an invalid carrier having a stable supporting wheel configuration.

It is yet another object of this invention to provide an invalid transport having a seating area which could be selectively raised and lowered to permit alignment with a variety of seating heights to which an invalid may be transferred.

It is still another object of this invention to provide an invalid transport having a tilting seat area, permitting an invalid's legs to be raised over a low obstruction while simultaneously permitting the invalid's head to clear an overhead obstruction.

It is yet a further object of this invention to provide an invalid transport having arm rests which may be pivoted into a non-obstructing position, permitting the transported invalid to move sideways off the seating area of the transport.

SUMMARY OF THE ILLUSTRATIVE EMBODIMENT

An embodiment of this invention is disclosed in which an invalid supporting seat is cantilevered from a central supporting column. The invalid seat is selectively positioned along the vertical axis to permit its alignment with a bed or auto seat to which the invalid will be transferred. The invalid seat may also be tilted to permit the invalid's legs and head to clear obstructions. The invalid's seat includes arm rests that provide lateral stability and safety to the invalid. The arm rests may be pivoted into a position giving unobstructed egress for the invalid from the supporting seat. The wheels of the invalid transport are low and the framework is unobstructed to permit placement of the invalid seat well beyond the edge of an automobile frame or a bed side rail.

DESCRIPTION OF THE DRAWINGS

FIGS. 6*a* – 6*d* show sequential views of an invalid being transported to, and transferred into, an automobile by the invalid transport shown in FIG. 1.

DETAILED DESCRIPTION OF THE ILLUSTRATIVE EMBODIMENT

In order to best illustrate the advantages and features of this invention, an invalid transport embodying the invention will be described as it would be used to transport an invalid to an automobile and assist in their entry into the automobile. It should be understood that this is not intended to indicate that this is the only utility of the invalid transport, since it could be used to transport an invalid to a variety of locations, such as to a toilet or to an X-ray facility.

Figure 1:
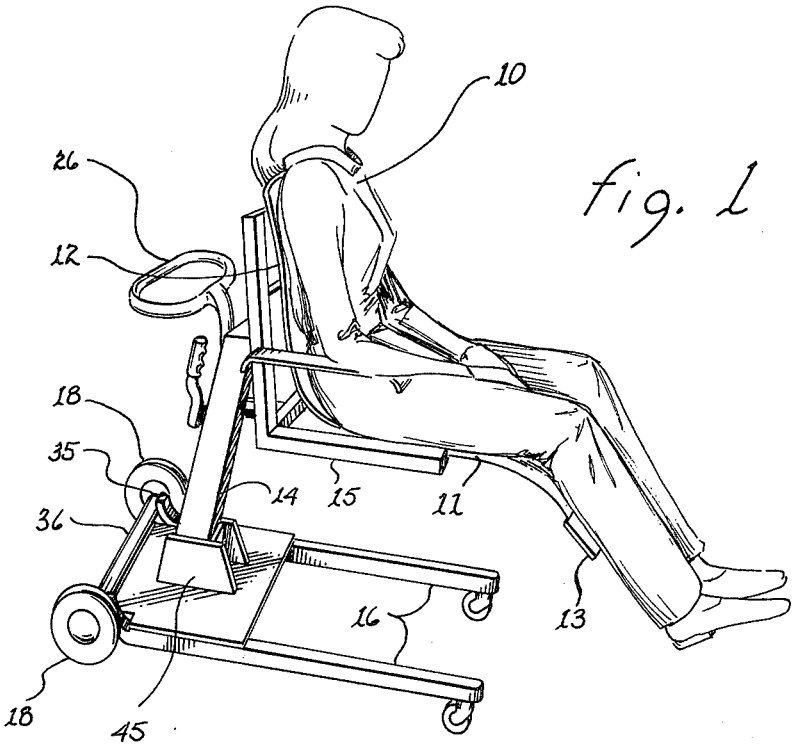
FIG. 1 is a perspective view of an invalid supported on an invalid transport embodying this invention.

An invalid 10 is shown in FIG. 1 being transported by an invalid transport embodying this invention. The invalid's buttocks and thighs are supported by a seat bottom 11 which is more clearly seen in FIGS. 2 and 3. Invalid 10 rests against a seat back 12 with a pair of leg rests 13 supporting the invalid's calves. Seat bottom 11 and seat back 12 may advantageously be fabricated from a single piece, such as formed stainless steel or molded plastic. An attendant propels and steers the invalid transport by pushing against a push bar 26 located at the rear of the transport or vehicle.

Figure 2:
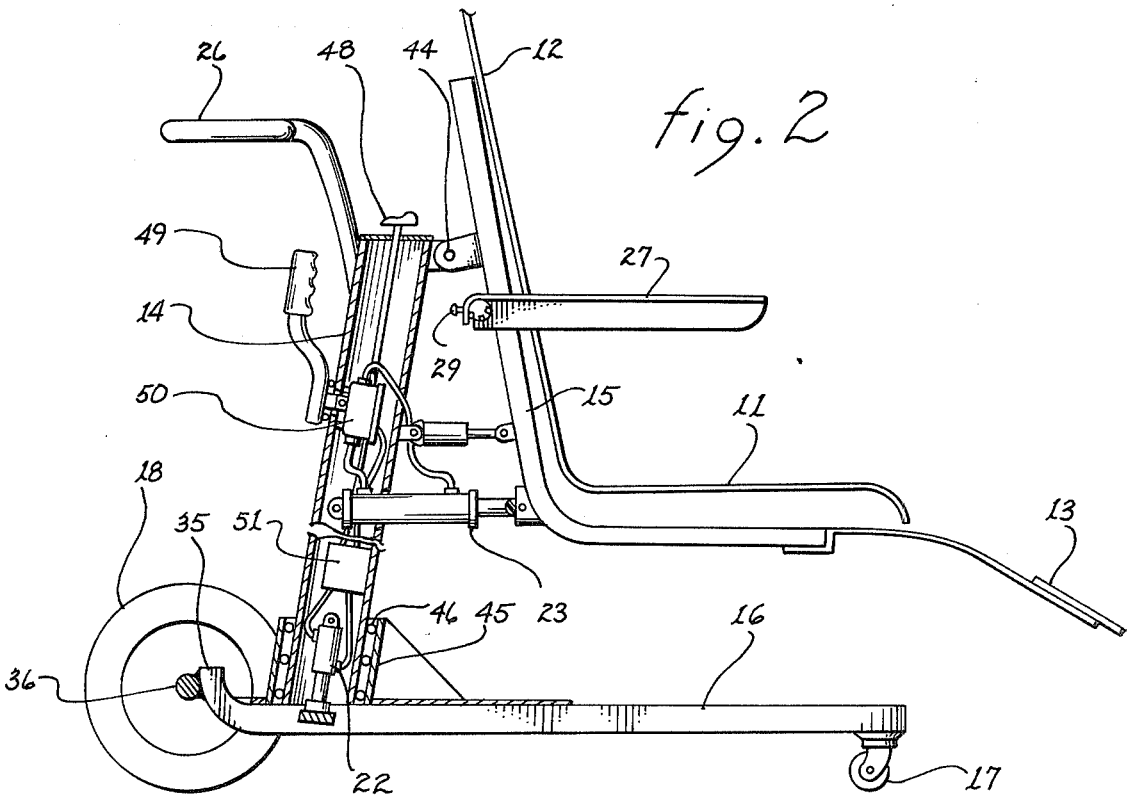
FIG. 2 is a side elevation of the invalid transport shown in FIG. 1.
Figure 3:
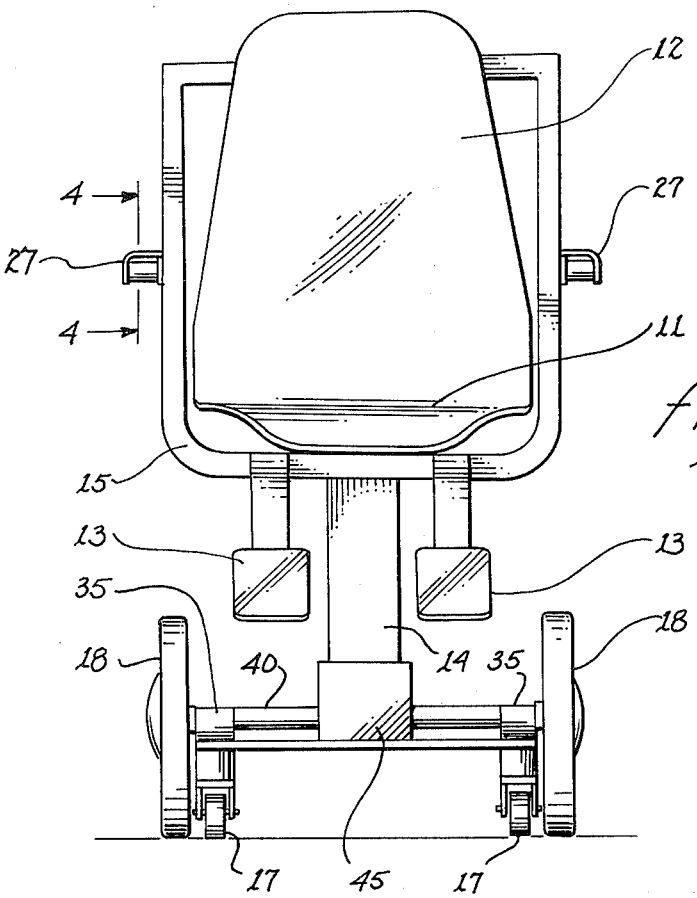
FIG. 3 is a front elevation of the invalid transport shown in FIG. 1.

As most clearly seen in FIG. 2, a lower frame 16 of the invalid transporting vehicle is maintained at a low profile by the small diameter of a pair of wide spaced front wheels 17. Due to this low profile, frame 16 can extend beneath and substantially beyond the edge of an automobile frame or the side rails of a hospital bed. The rear of frame 16 includes a pair of upwardly extending frame horns 35 to which an axle 40 supporting a pair of large diameter, wide spaced rear wheels 18 is attached. The wide spacing between, and large diameter of, rear wheels 18 provides substantial stability to the transport vehicle while permitting the transport vehicle to be readily moved. Although it is not shown, rear wheels 18 would normally have a locking brake associated with them to prevent unintended, and potentially dangerous, movement of the transport vehicle. Any of several arrangements well known in the art could be employed for this purpose.

Figure 4:
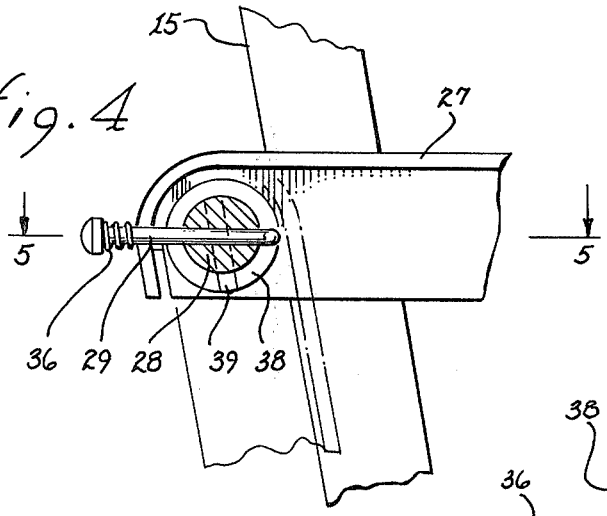
FIG. 4 is a partial cross-sectional view taken along the line 4—4 shown in FIG. 3.
Figure 5:
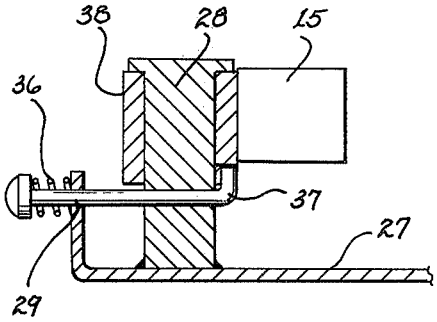
FIG. 5 is a partial cross-sectional view taken along the line 5—5 shown in FIG. 4.

An upper frame 15 supports seat bottom 11, back rest 12 and leg rests 13. In addition, frame 15 supports a pair of arm rests 27 on opposite sides of the seating area of the transport vehicle. As seen in FIGS. 4 and 5, each arm rest 27 attaches to frame 15 via a pivot pin 28. Pin 28 permits arm rest 27 to rotate from its upright position (shown in solid outline in FIG. 4) to a non-obstructing position (shown in broken outline in FIG. 4). Arm rest 27 is locked in the desired position by a locking pin 29 having an end hook 37. Hook 37 engages a locking indent 39 located in a locking cuff 38 which attaches to frame 15 and houses pivot pin 28. To rotate arm rest 27, locking pin 29 is depressed to move end 37 out of locking indent 39 of locking cuff 38. When arm rest 27 has been rotated to the desired position, locking pin 29 is released. A return spring 36 moves locking pin 29 back to a position where hook 37 engages locking indent 39, thereby locking arm rest 27 in the desired position. The significance of the movement of arm rest 27 will become more apparent later.

In order to facilitate movement of invalid 10 into and out of the transport vehicle, upper frame 15 is vertically adjustable to a desired height. This permits seat bottom 11 to be aligned with a hospital bed, for example, to facilitate ingress or with an automobile seat, for example, to facilitate egress. Frame 15 is secured to a supporting column 14 which telescopes to produce the vertical adjustment. The lower end of column 14 is secured in a support collar 45 which is attached to lower frame 16. Roller bearings 46 are positioned between collar 45 and column 14 to facilitate the telescopic movement of the column when an elevation controlling hydraulic cylinder 22 is actuated, as will be explained later in more detail. It will be noted that pedestal 14 is angled forward on frame 16. This, in combination with the rearward location of support collar 45, permits the seat area of the transport vehicle to be extended substantially beyond the edge of an obstruction such as a bed or automobile.

In addition to being adjustable vertically relative to frame 16, the seat area of the transport vehicle may also be selectively tilted relative to frame 16. The upper portion of upper frame 15 connects to column 14 at a frame pivot 44. When a tilt control hydraulic cylinder 23 is actuated, as will be explained later in detail, frame 15 and the seat area it supports is rotated about pivot 44. The significance of this feature will become apparent later.

The hydraulic system associated with the selective positioning of the seating area of the transport vehicle is located substantially within column 14. The system includes the two hydraulic cylinders 22 and 23, previously described. In addition, a selection control 48 is provided to select which of the two hydraulic cylinders is to be actuated. Control 48 works in conjunction with a pressurizing valve 50 which is controlled by an actuation handle 49 to either pump hydraulic fluid from a reservoir 51 into the hydraulic cylinder or to return fluid to the reservoir, depending upon the desired change in position of the seat area of the transport vehicle. To prevent possible injury to invalid 10 in the event of a hydraulic system failure, which could catapult invalid 10 forward if seat 11 suddenly dropped forward, a shock absorber 24 is positioned, as shown in FIG. 2, between frame 15 and column 14 to prevent sudden movement of frame 15.

OPERATION

The proper operation of the invalid transport vehicle is best understood in conjunction with FIGS. *6a* – *6d* which depict invalid 10 being transported to, and transferred into, an automobile 30. As shown in FIGS. *6a*, an attendant 53 propels the transport vehicle by pushing against push bar 26. In addition to transporting invalid 10, the invalid's luggage 54 is also transported by placing it upon frame 16 as shown.

When the transport vehicle reaches automobile 30, as shown in FIG. *6b*, attendant 53 unloads luggage 54 preparatory to assisting invalid 10 in entering the automobile. The seat area of the transport vehicle is now tilted backward, as was detailed earlier. With the seat area tilted backward, invalid 10's lower legs are elevated to bring the heels substantially above the upper level of frame 16. This allows the lower portion of invalid 10's body to clear auto frame 33 as invalid 10 is placed into automobile 30. Coincidentally, invalid 10's head is tilted backward to facilitate clearance of the roof 34 of the automobile 30.

With invalid 10's lower legs positioned inside automobile 30 as shown in FIG. *6c* (with door 31 shown removed for clarity), attendant 53 would move the transport vehicle to the position shown in FIG. *6d*. This movement may include adjusting the elevation of the seat area to coincide with that of auto seat 32. It would be anticipated that attendant 53 would have initially raised the seating area above the level of seat 32 to facilitate insertion of invalid 10's lower legs. Once invalid 10 is positioned inside automobile 30, the seat area of the transport vehicle could be lowered to actually contact seat 32.

The "inboard" arm rest 27 may now be moved to the non-obstructing position, as shown in FIG. *6d*, thereby permitting invalid 10 to transfer from the transport vehicle to seat 32 of automobile 30. If invalid 10 lacks the mobility to effect such a transfer, attendant 53 would lock the vehicle wheels to prevent movement of the vehicle. Attendant 53 would then move around automobile 30 to enter by the opposite door to door 31. Attendant 53 could then reach across seat 32 to effect invalid 10's transfer. The continuing presence of the "outboard" arm rest 27 in its upright position would prevent invalid 10 from falling from the unattended vehicle.

By way of illustration only, front wheels 17 may advantageously be 3 to 4 inches in diameter, rear wheels 18 may be eight to nine inches in diameter, and column 14 may be located approximately 75° to the horizontal plane of frame 16. Other modifications would, of course, be possible to one skilled in the art and would be within the spirit and scope of this invention.

We claim:

1. A vehicle for transporting an invalid passenger, said vehicle comprising in combination:

a. a moveable base including 1. a pair of spaced apart front wheels having a diameter small enough to fit beneath the side frame of an automobile, and 2. a pair of spaced apart rear wheels having a diameter larger than the diameter of said front wheels;

b. a pedestal connected to the rear of said base and extending upward at a frontward angle of less than 90° therefrom;

c. a seat cantilevered frontward from said pedestal for supporting the back and legs of an invalid;

d. a leg rest extending frontward from said seat and located at a downward angle from said seat for supporting the calves of said invalid, thereby maintaining the heels of said invalid above the top of said front wheels;

e. means for selectively tilting said seat relative to said base;

f. means for selectively raising and lowering said seat relative to said base; and g. a pair of arm rests connected to said seat and individually moveable to a position which does not obstruct access to the side of said seat.

2. A vehicle in accordance with claim 1, wherein said pedestal extends frontward at an angle of approximately 75° relative to said base.

3. A vehicle in accordance with claim 1, wherein the diameter of said front wheels is less than 6 inches and the diameter of said rear wheels is greater than 6 inches.

* * * * *